US005422445A

United States Patent [19]

Baird et al.

[11] Patent Number: 5,422,445

[45] Date of Patent: Jun. 6, 1995

[54] VEHICULAR MUFFLER HAVING EXPANSION JOINT

[75] Inventors: William J. Baird; Gerald Hayes, both of Hartford, both of Wis.; Steven P. DeMik, Worth, Ill.

[73] Assignee: Midas International Corporation, Chicago, Ill.

[21] Appl. No.: 226,059

[22] Filed: Apr. 11, 1994

[51] Int. Cl.[6] ..... F01N 7/18

[52] U.S. Cl. ..... 181/282

[58] Field of Search ..... 181/247-251, 181/243, 282; 29/890.08

[56] References Cited

U.S. PATENT DOCUMENTS

| | | | |
|---|---|---|---|
| 2,187,431 | 2/1938 | Powell . | |
| 2,259,516 | 9/1940 | Deremer . | |
| 3,289,785 | 12/1966 | Walker . | |
| 3,645,092 | 2/1972 | Tatsutomi . | |
| 3,903,987 | 9/1975 | Brown et al. | 181/282 |
| 3,945,460 | 3/1976 | McMillan | 181/282 |
| 4,333,545 | 6/1982 | Roberts . | |
| 4,793,544 | 12/1988 | Fukuda . | |
| 4,851,298 | 7/1989 | Fukuda . | |

*Primary Examiner*—Khanh Dang
*Attorney, Agent, or Firm*—Anthony S. Zummer

[57] ABSTRACT

A vehicular muffler has a body with endcaps mounted on opposed ends thereof. The body has an outer wrap and an inner wrap. The outer wrap is sheet metal having opposed edges overlapping each other to form a closed figure. The opposed overlapping edges are an outer edge and an inner edge. The inner wrap is sheet metal having opposed margins overlapping each other. The opposed margins are an inner margin and an outer margin. The inner margin has a portion adjacent to the inner edge. The outer margin is positioned between the inner margin and the outer wrap to form a gap between the terminus of the outer margin and the terminus of the inner edge.

13 Claims, 1 Drawing Sheet

VEHICULAR MUFFLER HAVING EXPANSION JOINT

BACKGROUND OF THE INVENTION

Vehicular mufflers are mandated by many governmental bodies to reduce the noise which emanates from an internal combustion engine. A typical construction for a vehicular muffler is one which includes an elongated body with end caps mounted on the opposed ends. Nipples on the end caps provide connections for an inlet to the muffler and an outlet from the muffler. A louver and baffle assembly is mounted within the body to muffle the noise from an internal combustion engine in a typical construction of a muffler. The body is made up of an outer wrap and an inner wrap positioned within the outer wrap. Both wraps are typically made of a sheet metal. In many instances, the sheet metal is aluminized cold rolled steel. A typical and well-known method of construction of a muffler includes the step of wrapping an inner wrap of sheet steel around a mandril, and an outer wrap is also formed around the same mandril over the inner wrap. The two wraps are seam welded. The louver and baffle assembly is inserted into the body. End caps are attached to the body to encase the louver and baffle assembly.

The construction mentioned above is taught in a number of U.S. Patents. Fukuda U.S. Pat. No. 4,851,298 entitled "Multi-Layer Tube Of A Muffler For An Internal Combustion Engine" was issued Jul. 25, 1989. The Fukuda patent shows sheets 18 and 20 which are spot welded to themselves and are interconnected at a coupling portion 22. Fukuda U.S. Pat. No. 4,793,544 entitled "Method Of Producing A Multi-Layer Tube Of A Muffler" issued Dec. 27, 1988. The second mentioned Fukuda patent also discloses sheets 18 and 20 which are spot welded to themselves. Roberts U.S. Pat. No. 4,333,545 entitled "Back-Fire Resistant Lock Seam For Muffler Shells" issued Jun. 8, 1982. This disclosure teaches a muffler construction wherein a tongue 24 is spot welded to a portion of the wrap.

The typical and well-known construction of vehicular mufflers presents certain problems. In many instances, there is a considerable amount of shell noise between the two wraps of the shell. The noise is sometimes referred to oil canning. This is a phenomenon wherein the inner wrap or outer wrap vibrates due to pressure pulsations, temperature differences, thermal expansion and stress built up in the muffler body.

SUMMARY OF THE INVENTION

The present invention provides a vehicular muffler having an elongated body and an end cap sealingly mounted on each of the opposite ends of the body. The body has an outer wrap and an inner wrap. The outer wrap is sheet metal having opposed edges overlapping each other to form a closed figure. The opposed overlapping edges are an outer edge and an inner edge. The inner wrap is sheet metal having opposed margins overlapping each other. The opposed margins are a inner margin and an outer margin. The inner margin has a portion adjacent to the inner edge. A weld secures the outer edge to the inner edge and the inner edge to the inner margin. The outer margin is positioned between the inner margin and the outer edge forming a gap between the terminus of the outer margin and the terminus of the inner edge to allow the outer margin to move relative to the inner edge. The freedom of the outer margin to move relative to the inner edge allows the inner wrap to remain in constant thermal contact with the interior of the outer wrap, thereby relieving stress in the weld area. Voids between the wraps are eliminated, thereby producing better heat transfer from the inner wrap to the outer wrap. Furthermore, shell noise is substantially eliminated by allowing exhaust gases to be vented from between the two wraps and stress is substantially eliminated.

DESCRIPTION OF A SPECIFIC EMBODIMENT

Figure 1:
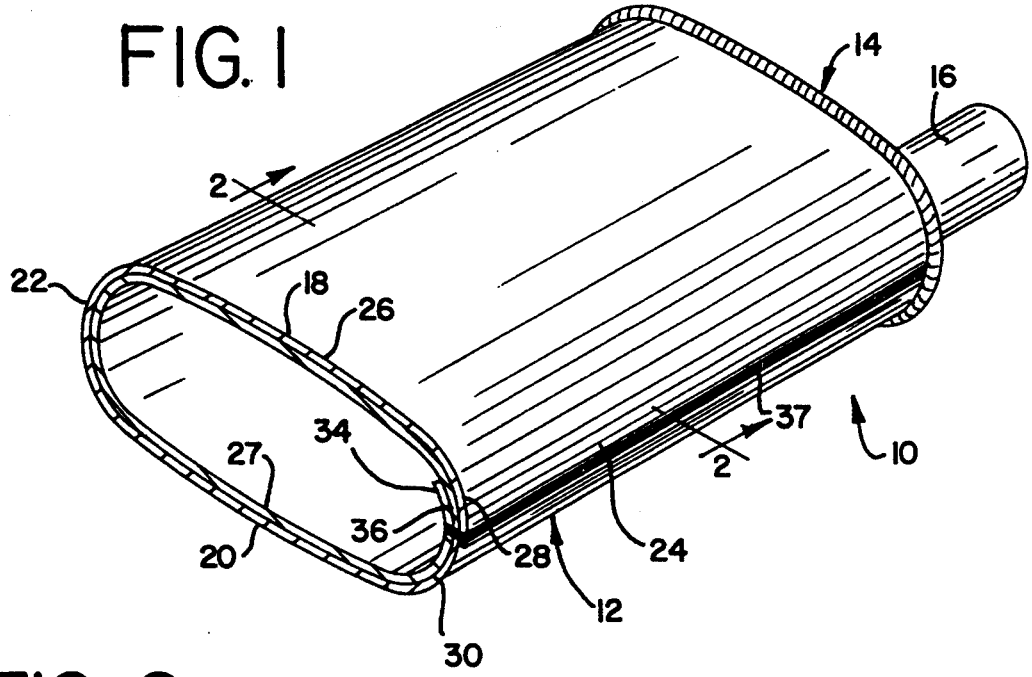
FIG. 1 is a perspective view of a portion of a vehicular muffler embodying the herein disclosed invention with an end cap removed and a louver and baffle assembly removed in order to show better the present invention.

Referring now to the drawing and especially to FIG. 1, a portion of a vehicular muffler embodying the present invention is shown therein and is generally indicated by number 10. Muffler 10 generally includes an elongated body 12 with an end cap 14 sealingly mounted on one end of the body. The end cap as is conventional includes a nipple 16 mounted therein to provide a conduit to the interior of body 12. The other end of body 12 is closed by an end cap with a nipple which are not shown herein in view of the fact that this construction is conventional and well known in the art. The interior of the body contains a louver and baffle assembly which is not shown herein since it is also conventional and well known in the art.

Figure 2:
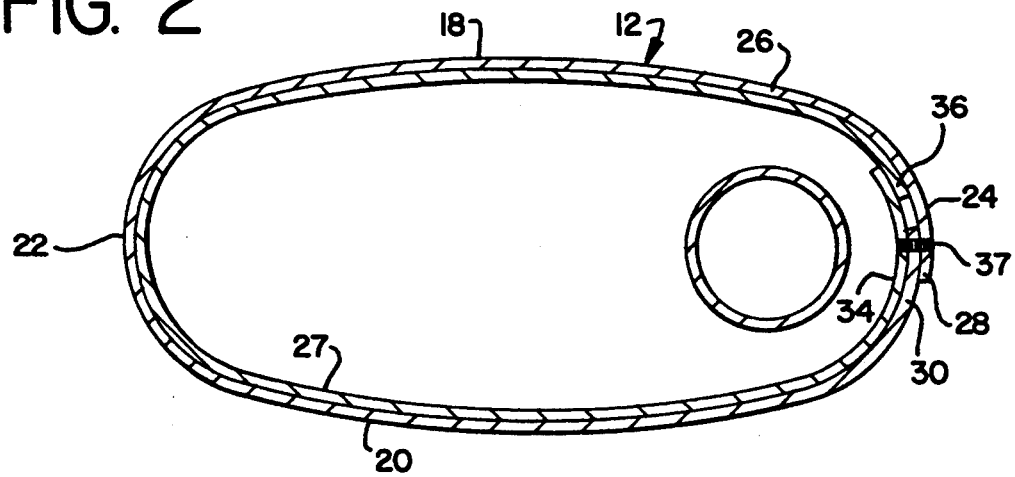
FIG. 2 is a cross sectional view taken on line 2—2 of FIG. 1 showing the cross sectional shape of a body of the vehicular muffler.
Figure 4:
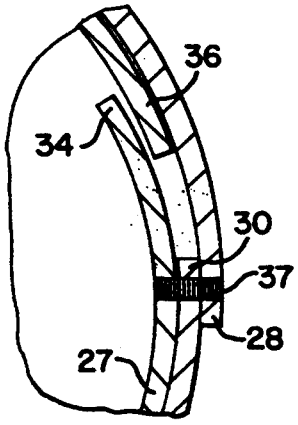
FIG. 4 is a further enlarged view of a portion of the cross sectional view of FIG. 3 showing the positioning of the terminus portions of the outer wrap and the inner wrap and the location of a weld holding together parts of the outer wrap and inner wrap.

As may be seen in FIG. 2, body 12 has a cross section which is a closed figure. In this instance, the closed figure has a generally elliptical outline wherein an arched upper portion 18 is connected to an arched lower portion 20 by a curved continuous side 22 and a curved connected side 24. The curved connected side includes an expansion joint for the body. Body 12 includes an outer wrap 26 and an inner wrap 27 both of which conform to the baffle (not shown herein) to define the outline of the body. Outer wrap 26 includes an outer edge 28 which overlays an inner edge 30 as may be best seen in FIG. 4 to form a closed figure. Inner wrap 27 has a substantial portion of its exterior surface in contact with a substantial portion of the interior surface of outer wrap 26. The inner wrap includes an inner margin 34 which extends beyond inner edge 30, as may be best seen in FIG. 4. The inner wrap also includes an outer margin 36 which is positioned between inner margin 34 and outer edge 28 to form a second closed figure similar to the closed figure formed by the outer wrap.

In this instance, the outer wrap is made of 0.019 inch aluminized cold rolled sheet steel, while the inner wrap is made of 0.021 inch cold rolled sheet steel. Inner margin 36 has a thickness which is greater than the thickness of inner edge 30.

A seam weld 37 extends along the length of body 12. Seam weld 37 is positioned in a line substantially parallel to and adjacent to the terminus of outer edge 28. The seam weld fixes outer edge 28 to inner edge 30 and inner edge 30 to inner margin 34 as may be best seen in FIG. 4. Inasmuch as the outer wrap is 0.019 inch thickness and the inner wrap is 0.021 inch thickness, the thickness of inner edge 30 is less than the thickness of outer margin 36. Outer margin 36 is retained between inner margin 34 and the outer wrap, but the outer margin may move to change the size of the gap between the terminus of the outer margin and the terminus of the inner edge.

Figure 3:
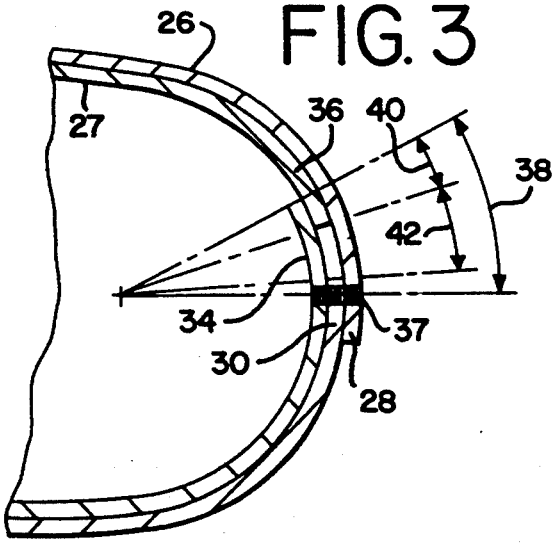
FIG. 3 is an enlarged fragmentary cross sectional view of a portion of the body of FIG. 1 showing the interrelationship of the terminus portions of the outer wrap and the inner wrap.

Looking now to FIG. 3, the terminus of the inner margin and spot weld 37 form an off-set angle 38, which in this instance, is 28 degrees. The angle defined by the terminus of the outer margin and the terminus of the inner margin is an overlay angle 40, which is 10 degrees. The angle between the terminus of the outer margin and the inner edge defines a gap angle 42, which is 15 degrees. Although specific materials, specific sizes and specific interrelationships are disclosed herein, the various identified specific parameters may be varied to adjust for a given application.

During operation of the muffler, the inner wrap is exposed to hot exhaust gases from an internal combustion engine. Since the inner wrap is heated first, there is a temperature differential between the inner wrap and the outer wrap. The temperature differential causes the inner wrap to expand a greater amount than the outer wrap. The freedom of outer margin 36 to move along the interior surface of the outer wrap allows the outer margin to move toward inner edge 30 and thereby reduce the size of the gap. There is a continuity of engagement of the inner wrap with the outer wrap eliminating the opportunity for buckling or oil canning. When internal combustion exhaust gases are no longer passed through the muffler, the inner wrap then cools so that outer margin 36 is free to move away from inner edge 30 when the inner wrap contracts from its heated and expanded state. When the outer wrap and the inner wrap achieve ambient temperature, there is no temperature differential between the inner wrap and the outer wrap, and there is no differential in expansion of both wraps. However, when the exhaust gases are again introduced into the muffler, the inner wrap is again heated to expand the inner wrap more than the outer wrap. The cycling of the heating and cooling of the muffler has no adverse effect on the muffler construction since the inner wrap is allowed to expand a greater amount than the outer wrap by virtue of the provision of the expansion joint in the muffler body.

A specific embodiment of the herein disclosed invention has been shown in the accompanying drawing and described in detail in the foregoing specification. Those skilled in the art may make various modifications and changes from the herein disclosed invention without departing from the spirit and scope of this invention. It is to be expressly understood that the present invention is limited only by the appended claims.

What is claimed is:

1. In a vehicular muffler having an elongated body, said body having an outer wrap and an inner wrap, said outer wrap being sheet metal, said outer wrap having opposed edges overlapping each other to form a closed figure, said opposed overlapping edges being an outer edge and an inner edge, said inner wrap being sheet metal and positioned within the outer wrap, said inner wrap having opposed margins overlapping each other forming a second closed figure similar to the first mentioned closed figure, said opposed margins being an inner margin and an outer margin, said inner margin having a portion adjacent to the inner edge, said outer margin positioned between the inner margin and the outer wrap defining a gap between the terminus of the outer margin and the terminus of the inner edge, said gap is variable in response to the temperature difference between the respective temperatures of the inner and outer wraps.

2. In a vehicular muffler as defined in claim 1, wherein said inner edge is fixed to the outer edge, the inner margin is fixed to the inner edge, and the outer margin is movable relative to the inner edge.

3. In a vehicular muffler as defined in claim 1, wherein the inner edge is welded to the outer edge, said inner edge is welded to the inner margin, and said outer margin is movable relative to the inner margin.

4. In a vehicular muffler as defined in claim 1, wherein the sheet metal of the outer wrap has a thickness less than the thickness of the sheet metal of the inner wrap.

5. In a vehicular muffler as defined in claim 1, wherein the thickness of the outer margin is less than the thickness of the inner edge.

6. In a vehicular muffler as defined in claim 1, wherein a substantial portion of the exterior surface of the inner wrap is in thermal engagement with the interior surface of the outer wrap.

7. In a vehicular muffler as defined in claim 1, wherein the elongated body has a cross section which is a closed figure, and the closed figure has a curved portion to allow a portion of the inner wrap to move relative to the interior surface of the outer wrap.

8. In a vehicular muffler as defined in claim 1, wherein the inner edge is fixed to the outer edge, the inner margin is fixed to the inner edge, and the thickness of the sheet metal of the inner wrap is greater than the thickness of the sheet metal of the outer wrap.

9. In a vehicular muffler as defined in claim 1, wherein a substantial portion of the exterior surface of the inner wrap is engagement with a portion of the interior surface of the outer wrap, said inner edge is fixed to the outer edge, the inner margin is fixed to the inner edge, and the outer margin is movable relative to the inner edge.

10. In a vehicular muffler as defined in claim 1, wherein the elongated body has a cross section which is a closed figure, said closed figure has a curved portion to allow a portion of the inner wrap to move relative to the interior of the outer wrap, said inner edge is fixed to the outer edge, the inner margin is fixed to the inner edge, and the outer margin is movable relative to the inner edge.

11. In a vehicular muffler as defined in claim 1, wherein a substantial portion of the exterior surface of the inner wrap is in engagement with the interior of the outer wrap, the inner edge is welded to the outer edge, said inner edge is welded to the inner margin, the outer margin is movable relative to the inner edge, and the sheet metal of the outer wrap has a thickness less than the thickness of the sheet metal of the inner wrap.

12. In a vehicular muffler as defined in claim 1, wherein the elongated body has a cross section which is a closed figure, said closed figure has a curved portion to allow a portion of the inner wrap to move relative to the interior of the outer wrap, said inner wrap has a substantial portion of its exterior surface in thermal contact with the interior of the outer wrap, the inner edge is welded to the inner margin, the outer edge is welded to the inner edge, the outer margin is movable relative to the inner margin, and the sheet metal of the outer wrap has a lesser thickness than the thickness of the sheet metal of the inner wrap.

13. In a vehicular muffler as defined in claim 1, wherein the inner edge is fixed to the outer edge, the inner margin is fixed to the inner edge, the outer margin is movable relative to the inner edge, the elongated body has a closed figure cross section, said closed figure has a curved portion to allow a portion of the inner wrap to move relative to the interior surface of the outer wrap, the thickness of the outer margin is less than the thickness of the inner edge, and a substantial portion of the exterior surface of the inner wrap is in engagement with the interior surface of the outer wrap.

* * * * *